US005813302A

United States Patent [19]

Haglund

[11] Patent Number: 5,813,302

[45] Date of Patent: Sep. 29, 1998

[54] SAWING APPARATUS

[76] Inventor: Åke Haglund, 1504-110 W. 4th Street, N. Vancouver B.C., Canada, V7M 3H3

[21] Appl. No.: 709,154

[22] Filed: Sep. 6, 1996

Related U.S. Application Data

[62] Division of Ser. No. 167,935, filed as PCT/SE92/00460, Jun. 24, 1992, abandoned.

[30] Foreign Application Priority Data

Jun. 24, 1991 [SE] Sweden ..... 9101916

[51] Int. Cl.[6] ..... B26D 7/06

[52] U.S. Cl. ..... 83/156; 83/425.1; 83/425.2; 83/436.3

[58] Field of Search ..... 83/156, 425.1, 83/425.2, 435, 435.1, 435.2, 436.3, 477.1, 703

[56] References Cited

U.S. PATENT DOCUMENTS

| | | | |
|---|---|---|---|
| 877,392 | 1/1908 | Zeitinger . | |
| 3,813,980 | 6/1974 | Rand et al. | 83/471.3 |
| 4,027,563 | 6/1977 | Weavell | 83/156 |
| 4,074,601 | 2/1978 | Warren et al. | 83/425.2 |
| 4,445,411 | 5/1984 | Purcell | 83/425.2 |

FOREIGN PATENT DOCUMENTS

| | | |
|---|---|---|
| 2182891 | 12/1973 | France . |
| 2451810 | 10/1980 | France . |
| 3031629 | 3/1981 | Germany . |
| 3714769 | 11/1988 | Germany . |
| 8005291 | 8/1984 | Sweden . |

*Primary Examiner*—Maurina T. Rachuba
*Attorney, Agent, or Firm*—Lackenbach Siegel, Marzullo Aronson & Greenspan, P.C.

[57] ABSTRACT

Sawing apparatus including a support, a first saw (3) and a feed table (4) which is designed to support a log to be sawn and which is movable to and fro relative to the support in order to move the log past the first saw. The apparatus includes a second saw (7) which is adjustable essentially laterally across the path of the feed table thus enabling adjustment of the cut width between the saws. In addition the sawing apparatus is equipped with a transporter (9) for timber pieces to the side of and along the path of the feed table (4).

8 Claims, 12 Drawing Sheets

SAWING APPARATUS

This is a Continuation and/or Division of application Ser. no. 08/167,935, filed as PCT/SE92/00460, Jun. 24, 1992 now abandoned.

The subject of the present invention is a sawing apparatus. This primarily, entails a sawing apparatus comprising a support, a sawing means and a feed means which is designed to support a log to be sawn and which is movable both forwards and backwards in relation to the support in order to be able to move the log past the sawing means.

BACKGROUND OF THE INVENTION

Hitherto known sawing apparatus of this kind has been much appreciated as it has been possible to produce at a reasonable cost. These known machines have, however, had the drawback that they have had a relatively limited capacity. The sawing of a log normally requires a number of different saw cuts before the log is fully sawn up. This entails the necessity of repeatedly moving the feed means, here in the form of a feed table, to and fro for each separate log, whereupon the known machines have made a saw cut through the log during each movement, as the known machines have only had a single sawing means. On the known machines, the sections that have been obtained during a single saw cut will either move backwards with the feed table or some form of outfeed device may deflect one of the pieces of sawn timber obtained from a saw cut off the table. In the former case a problem occurs as, when the feed table regains its original position, it is holding two pieces of timber, only one of which is to undergo further sawing operations in the feed table's next sequence of operations; the remaining piece of timber must therefore be removed from the feed table by the operator, entailing fairly strenuous work. In the latter case an accumulation of timber pieces will arise in the vicinity of the feed table when in its most advanced position, which, in some cases at least, will have to go through yet another sawing operation. Should the timber pieces be of such a kind that they are to undergo yet another sawing operation in the sawing machine, they must be transported back by some means to the vicinity of the feed table's start position; in other cases they must be transported to other equipment in the form of, for example, edging machines, for further processing.

SUMMARY OF INVENTION

The purpose of the present invention is to show ways of developing the sawing apparatus in question so that it may gain a considerable improved sawing capacity with no or relatively little increase in cost.

This goal is reached by the present invention through the specific characteristics which are defined in more detail in the forgoing specification.

The machine or sawing apparatus of the invention has a transporter for timber pieces alongside the path of the feed means. This transporter gives considerably heightened efficiency in that it makes it possible to transport timber pieces parallell to the path of the feed means. This means that the timber pieces which have been obtained as a result of a sawing operation can be transferred to the transporter in that portion of the latter which is in the vicinity of the feed means when in its forward position, so that the timber pieces on the transporter may be returned to a position alongside the feed means in its rear position. In the present case a second, adjustable, sawing means is installed on part, at least, of the breadth of the transporter, enabling timber pieces to be able to undergo a sawing operation during the transport process on the transporter, by way of the second sawing means alongside the path of the feed means. In a further development it is intended that one or more sawing means be fitted to cut timber pieces moving along the transporter. These extra sawing means may, for example, be fitted in such a way that they cut a piece of timber into planks in one single movement past the sawing means.

Using the transporter for sawing by means of the second or other sawing means, entails it being possible to make pieces of timber move in rapid succession on the transporter past the sawing means without the time-consuming effect which arises when using the feed means, as it must be moved to and fro. When, however, it is necessary for the feed means to fulfil its supporting and feeding purposes, i.e. during a number of introductory sawing sequences, typically to remove slabs from the log, the feed means is used with either one of both of the first and second sawing means. The sawing apparatus of this invention thus provides a high level of flexibility with regard to various ways of sawing timber.

It has already been mentioned above that sawing operations are delayed by the necessity of moving the feed means to and fro. When sawing large pieces of timber or logs or blocks this delay can be deemed defensible. In other cases, however, it may be a burden. One possible solution has already been implied above, that is carrying out the sawing operation during transport of the timber pieces on the transporter past the other or additional sawing means. Should there, however, be no such means, or if it should be impossible to utilize the transporter for such cutting purposes for some other reason, the reduction in capacity caused by the movement of the feed means to and fro will become burdensome. The present invention eliminates these problems by providing the feed means along the saw level of the sawing means with a essentially flat slide face, suitable conditions are created for allowing the feed means to remain stationary by the absence of any drive on the latter. Instead, other driving means are used to transport timber pieces one after the other while they are sliding in succession along the slide face.

The invention further has the advantage of allowing the various sections of the feed means to be utilized as drives to move the timber pieces past the sawing means in question while the remaining section of the feed means remains stationary.

The design of the sawing apparatus also provides and gives the machine operator a maximum of freedom as the various sawing means can be manoeuvred as required between inactive and active states, dependent on sawing conditions.

Other specific advantages of the invention are made clear in the remaining contingent patent claims.

BRIEF DESCRIPTION OF DRAWINGS

Referring to the enclosed drawings, the following is a more detailed description of one embodiment of the invention, presented as an example.

In the drawings.

DETAILED DESCRIPTION OF EMBODIMENT AS SHOWN IN FIGS. 1–10

Figure 1:
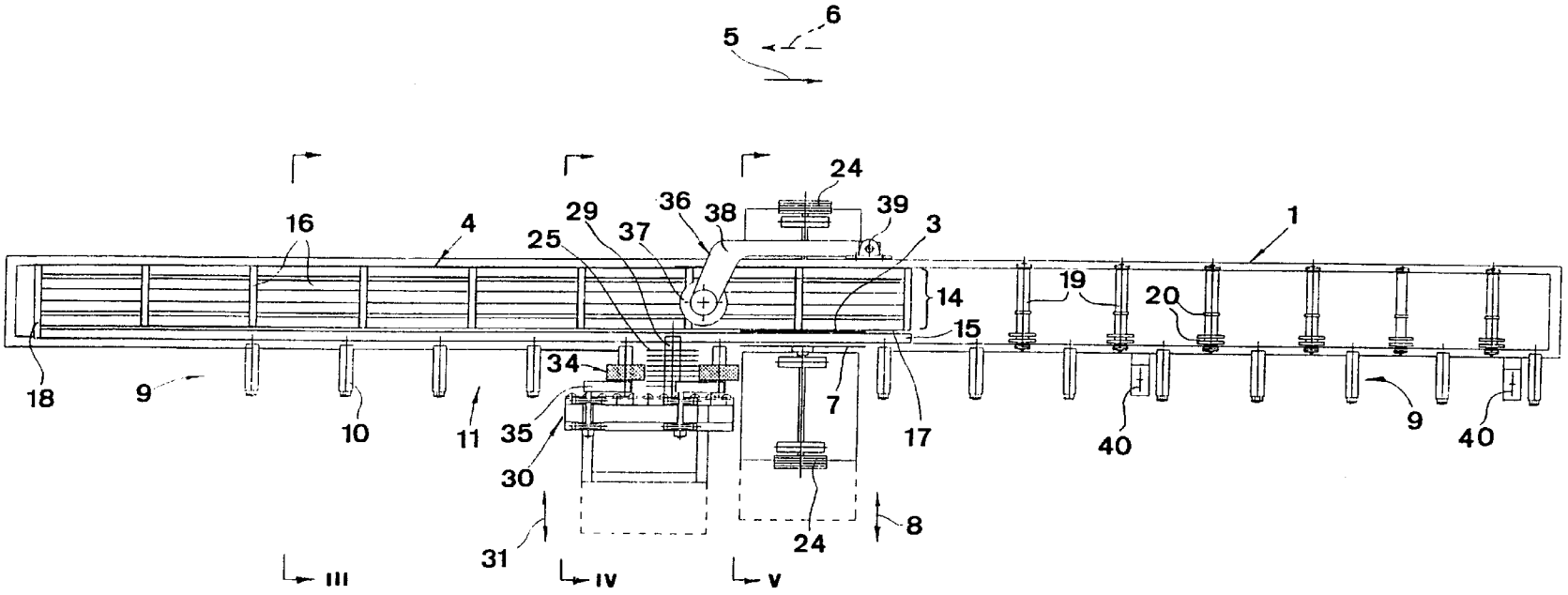
FIG. 1 is an outline horizontal section of the saw machine described in this invention.
Figure 2:
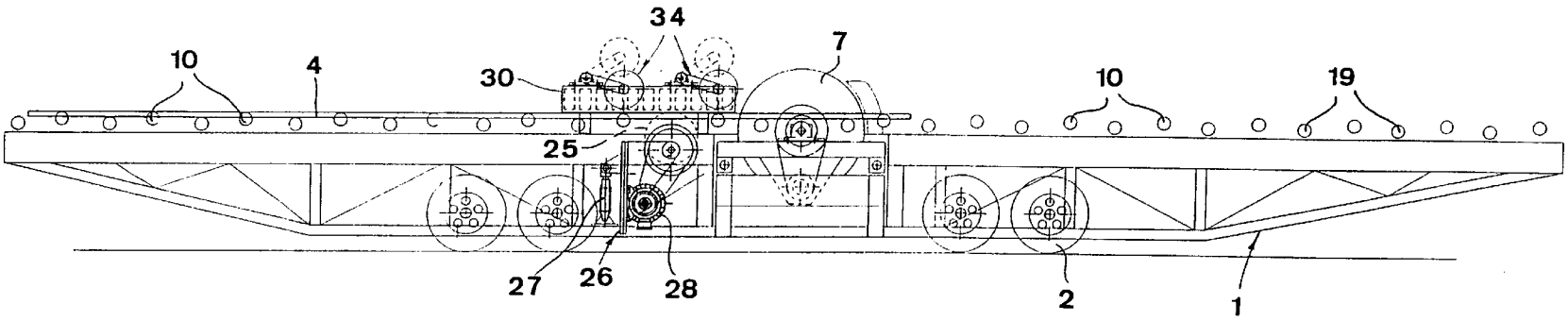
FIG. 2 is a view in side elevation of the sawing apparatus.

The sawing apparatus of the present invention comprises a general support, designated 1, which in the fashion illustrated in FIG. 2 can be fitted with wheels or similar to render the machine mobile. The machine further comprises a first sawing means 3, which has the form of a circular saw blade and a general feed means designated 4 which is designed to support a log to be sawn and which is movable to and fro in relation to the support 1 in order to move the log past the sawing means 3 during the cutting of the log. The sawing means 4 has the form of a feed table. In FIG. 1, the forward movement of the feed table 4 is shown by the continuous arrow 5 and the reverse movement is shown be the dashed arrow 6.

The machine comprises a second sawing means 7, which in the illustrated embodiment also has the form of a circular saw blade which is adjustable across the path of the feed means 4 in order to facilitate setting of the cut width between sawing means 3, 7. In FIG. 1 the direction of adjustment is shown by arrow 8.

Alongside the path of the feed table 4, the sawing apparatus has a transporter generically designated 9 for transporting timber pieces. This transporter 9 is situated side by side with the feed table 4 and its path with such a relative proximity between transporter and feed table that a log or timber piece to be cut can rest simultaneously on both feed table 4 and transporter 9. This is primarily a case of immediate proximity between transporter 9 and feed table 4.

Figure 3:
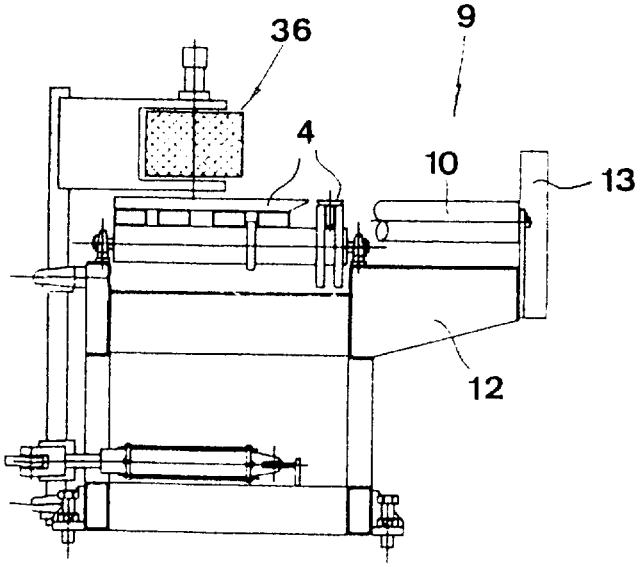
FIG. 3 is a fragmentary sectional view taken on the line III—III in FIG. 1.

Transporter 9 preferably comprises rollers 10 or other means of transportation attached to support 1. In the present embodiment the rollers 10 forming the transporter and their accompanying supports are attached to support 1 in such a way that between some pairs of adjacent rollers at least, the operator is able to gain access, thereby making it easier to serve the machine and reach the workpieces thereon. For the sake of clarity, arrows 11 in FIG. 1 show in a number of places how the operator can pass between two adjacent rollers 10 forming the transporter. From FIG. 3 in particular it can be seen how a specific roller 10 is supported by a support 12 in the form of a cantilever bracket projecting from the machine support 1. It can also be seen from FIG. 3 that certain rollers at least can be furnished with projecting buffer lugs 13 to prevent timber pieces from falling off the transporter 9. These buffer lugs 13 are preferably attached to supports 12 and are also preferably foldable so that, if necessary, timber pieces can be removed transversely from the transporter, possibly using special removal apparatus of known design, e.g. pivotal arms across the level of the transporter 9 in its longtudinal direction.

It is to be preferred that at least some of the rollers 10 constituting the transporter 10 be driven by either one or more motors so that the lumber pieces on the transporter 9 can be moved without the operator having to use manual power for this purpose. It is especially desirable that the rollers be reversibly driven so that the workpieces can be moved along the transporter 9 in both directions.

The upper surface of the transporter 9 is essentially aligned with the upper surface of the feed table, which can be seen in particular detail from FIGS. 3 and 6–10.

The feed table 4 comprises a relatively wide section 14 and a relatively narrow section 15. The narrow section 15 is designed to move to and fro in the gap between the first and the second sawing means 3, 7. The narrow design of section 15 is founded on the desire to be able to set the sawing means 3, 7 as close to each other as possible in order to be able to cut out a relatively thin piece of timber from a larger piece while the sawing means are in use simultaneously. On the other hand the narrow section 15 is necessary to support the timber piece being cut and located between the saw blades and in addition to move this timber piece in a forward direction.

The feed table 4 shows in its main section 14 a slotted design incorporating holes formed by longitudinal and latitudinal beams 16 to allow bark, sawdust etc. to pass through the feed table. The narrow feed table section 15 has, on the other hand, the form of a pole or rod and does not require through cavities because of its limited width.

FIGS. 1 and 2 show the feed table 4 in an intermediate position. It is however the intention that the feed table 4 be possible to be withdrawn even further in the direction of the arrow 6 so that the feed table will be located in its entirety in front of the sawing means 3, 7. In order to facilitate this the slot between sections 14 and 15 of the feed table wholly open in the direction of the feed table's forward movement (arrow 5), while the sections at the rear end of the feed table are connected to each other by the lateral connecting means 18. This entails that when the feed table is moved in a forward direction, the movement must be stopped before the connecting means 18 reaches the sawing means 3.

In the example the feed table 4 is shown mounted movably on a number of rollers 19. As can be seen from the figures, these rollers can be fitted with control means 20 intended to have a controlling effect together with its equivalent control means 21 on the feed table 4. In the example the control means 20, 21 are in the form of mutually interacting projections and cavities respectively, designed to prevent the feed table 4 making undesirable lateral movements. The example shows how the main section 14 of the feed table has a longitudinal cavity 21 which allows entry of a cylindrical projection 20 on the rollers 19. The feed table section 15 shows, conversely, a projection 21 which enters a cavity 20 formed by the rollers 19. This cavity, to be more precise, is formed by two mutually distanced cylindrical projections on a specific roller.

The feed table 4 can be driven forwards and in rerverse by arbitrary driving means, which, for example, comprise the rollers 19 in a driven embodiment or chains, ropes or similar in a known fashion.

Figure 6:
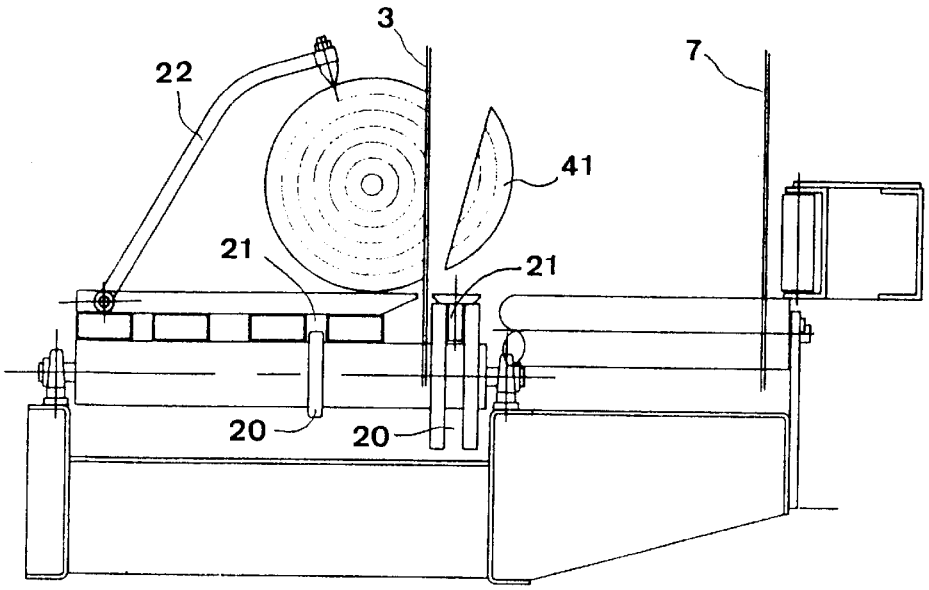
Figure 7:
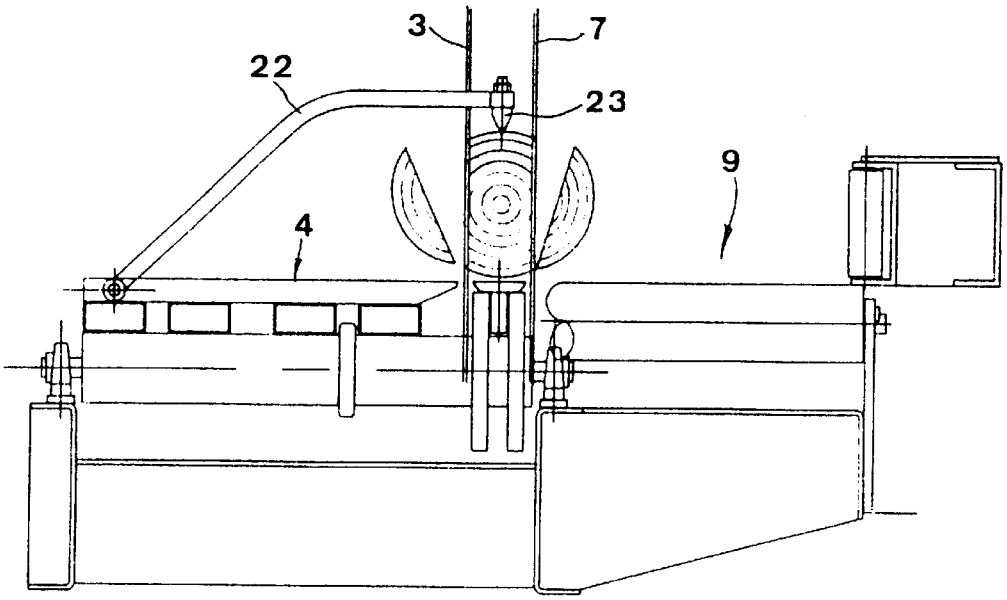

In order for the log to be kept in its correct position during cutting, the feed table is, as indicated by FIGS. 6 and 7, equipped with at least one holding means 22, which can brought to bear and hold the log, for example by its having one or more pins 23 which can be driven into the log.

The sawing means 7 is installed adjustably in the direction of the arrow 8 in at least some part of the breadth of the transporter. It can be seen from, for example, FIGS. 6 and 9 how the sawing means 7 can be moved to and fro in a cavity in the transporter 9, to be more precise between two adjacent rollers 10. The sawing means 7 is to be adjustable in a position relatively close to the sawing means 3 making possible a space between the two said sawing means into which section 15 of the feed table can enter. From this position close to the sawing means 3, sawing means 7 is to be adjustable, the use of specific driving means being recommended, to a position (see for example FIG. 6) where the sawing means 7 is at a considerable distance from the sawing means 3, preferably in the vicinity of that side of transporter 9 which is facing away from the feed table 4.

The sawing means 7 may for example together with its driving apparatus, be mounted on a sleigh or trolley which by way of the said driving means can be moved to and fro in the direction of the double arrow 8. The rotating axles of the sawing means 3, 7 are located under the upper surfaces of the feed table 4 and the transporter 9.

Figure 5:
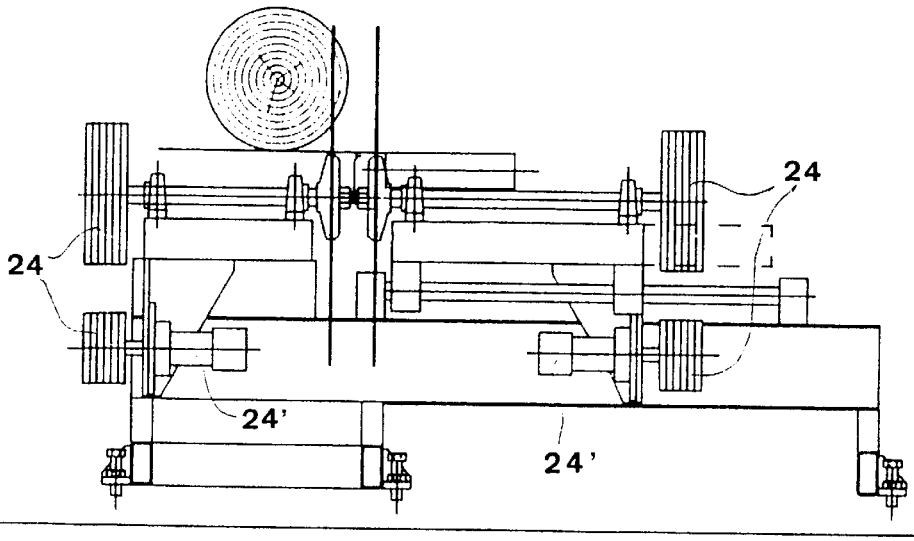
FIG. 5 is a fragmentary sectional view taken on the line V—V in FIG. 1, FIGS. 6–10 are views illustrating various methods of sawing using the machine in the present invention.

It can be seen from FIGS. 1 and 5 how the driving means of the sawing means 3 and 7 can include belt pulleys or similar 24 located on either side of the support 1 and motors 24'.

The sawing means 3, 7 have essentially horizontal rotating axles which are primarily essentially concentric.

Figure 4:
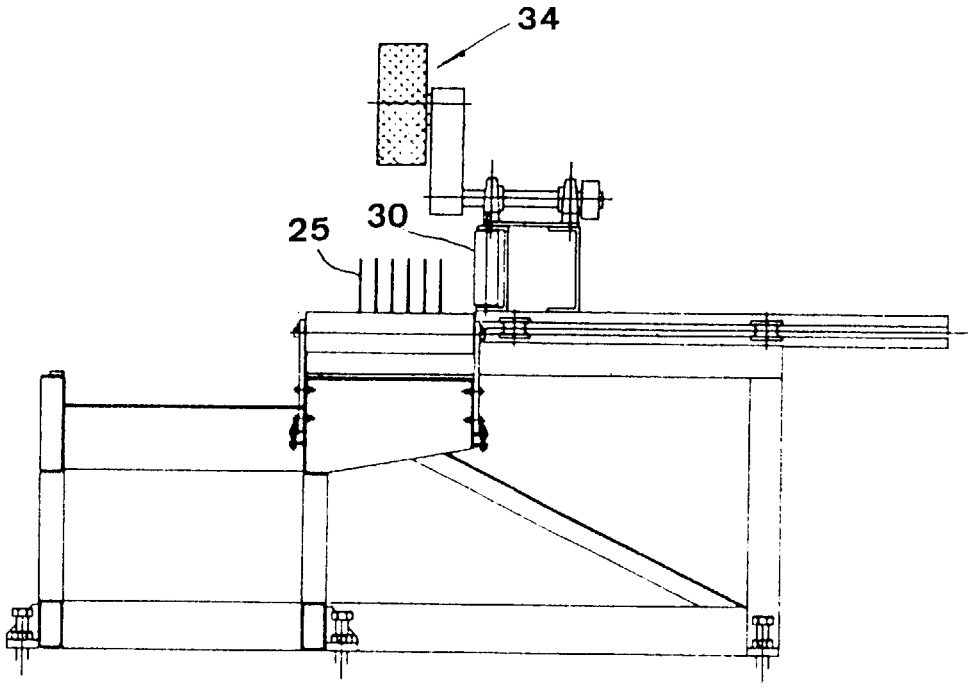
FIG. 4 is a fragmentary sectional view taken on the line IV—IV in FIG. 1.

The machine comprises one or more complementry sawing means 25 designed to cut timber pieces being moved on the transporter 9. The complementary saving means 25 are fitted so that they may be manoeuvred between an active setting (FIGS. 4 and 10), in which they are positioned for cutting timber pieces on the transporter 9, and an inactive setting, in which they are out of the way of the timber pieces which are being moved along the transporter 9. In the example, the sawing means 25 are fixed on a vertically movable support 26, powered by one or more driving means 27. When in the inactive position the said support is in such a low position that the other complementary sawing means are located under the supporting surface of the transporter 9.

Figure 10:
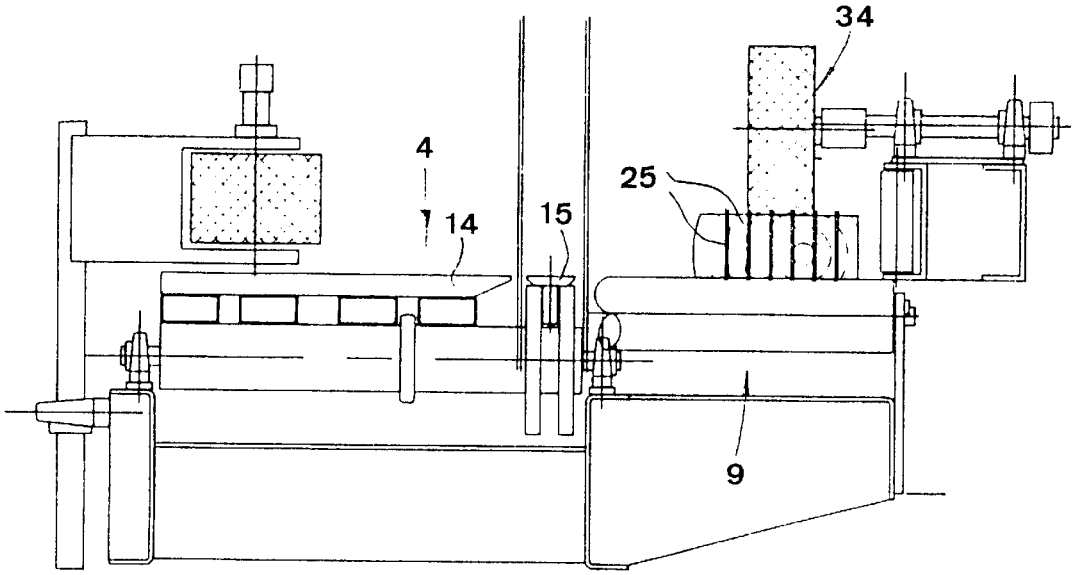

The sawing means 25 can occur in considerable numbers and they are fitted on a common axle which is set in rotation by the motor 28 seen in FIG. 2. The sawing means 25 can be aligned on their joint axle so that the distance between them can be varied for the purpose of carrying out the cutting of boards or similar, as can be seen in FIG. 10, from a timber piece moved forward on the transporter 9.

The machine includes an adjustable side stock 30 for timber pieces which are being moved in the sawing apparatus and this side stock 30 is laterally adjustable, as can be seen from FIGS. 6–10, relative to the transporter 9 on at least part of the width of the transporter. The range of movement of the stock is shown by the double arrow 31. The side stock 30 includes a support 32 to which can be attached a number of vertically oriented rollers 30 pressing against the timber pieces and allowing them to pass the stock with little friction.

The machine includes at least one hold-down means 34 to hold a timber piece down on the transporter 9. In the example two hold-down means are fitted and these are located on either side of the third sawing means 25. In the example the hold-down means 34 are brought against the stock 30 in order to follow the movement of the latter laterally across the transporter 9. The hold-down means 34 are recommended to have the form of wheels fitted to run against the timber piece, the wheels being carried by revolving arms 35 on bearings so that the hold-down means can be raised to an inactive position as is shown by dashed lines in FIG. 2.

It is to be preferred that the hold-down means 34 are driven and thus contribute to urging a timber piece along the transporter 9.

Figure 8:
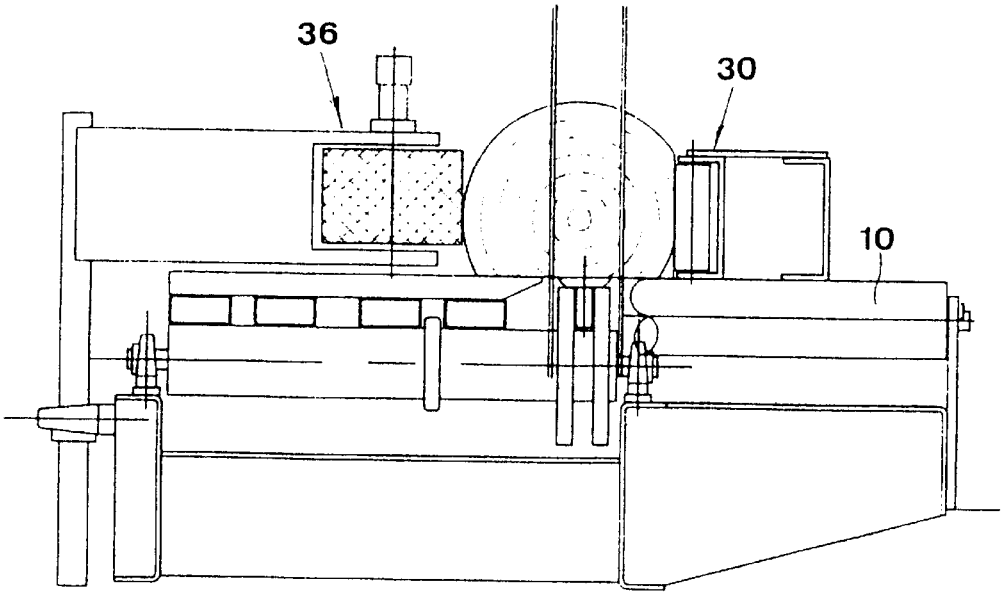
Figure 9:
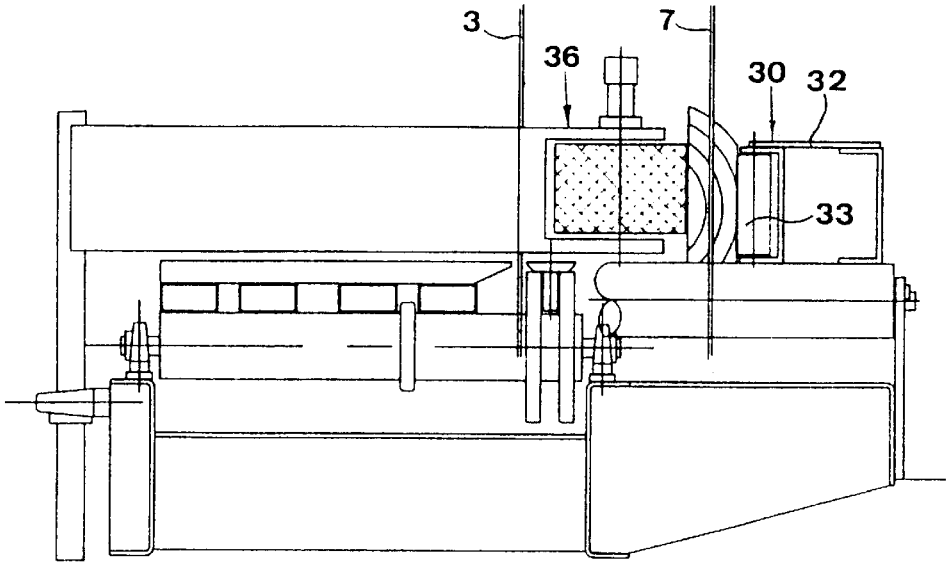

The machine further includes a stop 36 which presses the timber piece against the side stock 30 as can be seen from FIGS. 8 and 9. The stop 36 should comprise one or more rollers 37 to press against the timber piece and this roller should also be driven to contribute to moving the timber piece. The roller 37 is mounted on a support 38 which is movable towards and away from the side stock 30. In the example the support 38 is in the form of an arm rotating around an axle 39 on an essentially horizontal plane. It can be seen from FIG. 9 that the stop 36 should be capable of at least partially being moved over the transporter 9 so that it can press a timber piece in the direction of the side stock 30.

At 40 in FIG. 1 an indication is given of how at least one trimming saw 40, which can be raised and lowered, is fitted on or at the transporter 9 for longitudinal trimming of timber pieces. The timber pieces would thus be able to be cross-cut by way of the said triming saw while on the transporter 9. In the example two trimming saws are fitted, as can be seen from FIG. 1. The trimming saws are fitted in the space between adjacent pairs of rollers 10. Analogously, other equipment for processing timber pieces, such as planing machines etc., could be fitted in the spaces between the rollers 10.

FIGS. 6–10 show various forms of utilization: FIG. 6 shows the sawing of a relatively thick log where sawing means 3 alone is used, while the laterally adjustable sawing means 7 is moved aside and inoperative. The sawing creates a so-called slab 41 which could, for example, fall down on the transporter 9 to be transported to a position to the left of the transporter 9 referring to the views in FIGS. 1 and 2, to undergo further sawing operations. Alternatively the slabs 41 can be stored by the side of the transporter 9 in the vicinity of the right-hand side of the machine as seen in FIGS. 1 and 2. During sawing operations, the log is moved in the direction of the arrow 5 (FIG. 1) with the assistance of the feed table 4 and then the feed table is returned in the direction of the arrow 6 while the log is moving back. This can then, for example, be turned 90° and placed on the feed table for the cutting of another slab from the log. Subsequently, sawing operations as shown in FIG. 8 can be carried out, i.e. sawing means 3 and 7 would be set for cutting out a middle piece from the log while the latter was being pressed by the stop 36 against the correctly positioned side stock 30. The forward movement of the log is caused here partly by the feed table 4 and partly by the driven roller 37 of the stop.

The side piece of timber shown to the right, gained by the sawing operation in FIG. 8, may for example, be subjected to further cutting in the way illustrated in FIG. 9 while being moved along the transporter 9, i.e. the timber piece being sawn in FIG. 9 is moved back in the direction of the arrow 6 in FIG. 1, to undergo a new sawing sequence in the direction of the arrow 5, this sawing being carried out by the laterally adjustable sawing means 7 at the same time as the timber piece is being held between the stock 36 and the stop 30. The forward movement of the timber piece is effected by the driving of the rollers 10 and/or by the driven roller 37 of the stock 36. FIG. 10 shows how the middle piece created by the sawing operation shown in FIG. 8 can be laid on its flat side and, during its transportation on the transporter 9, be cut into boards using the third sawing means 25, while the hold-down means 34 hold the timber piece down against the transporter 9.

FIG. 7 shows, finally, how a smaller dimension log may be sawn simultaneously by sawing means 3, 7 while the log is moved forward by the feed table 4. Experts in the field consider, however, that the sawing machine of the invention also facilitates a number of other sawing applications than those shown in FIGS. 6–10.

EMBODIMENT SHOWN IN FIGS. 11–20

The embodiment shown in FIGS. 11–20 is largely the same as the embodiment already described above. In the following, therefore, only the differences will be presented in detail. Note that the numbered references in the embodiment described first have also been used for the following description, in so far as the parts referred to in this manner have not been altered to any great degree.

Figure 11:
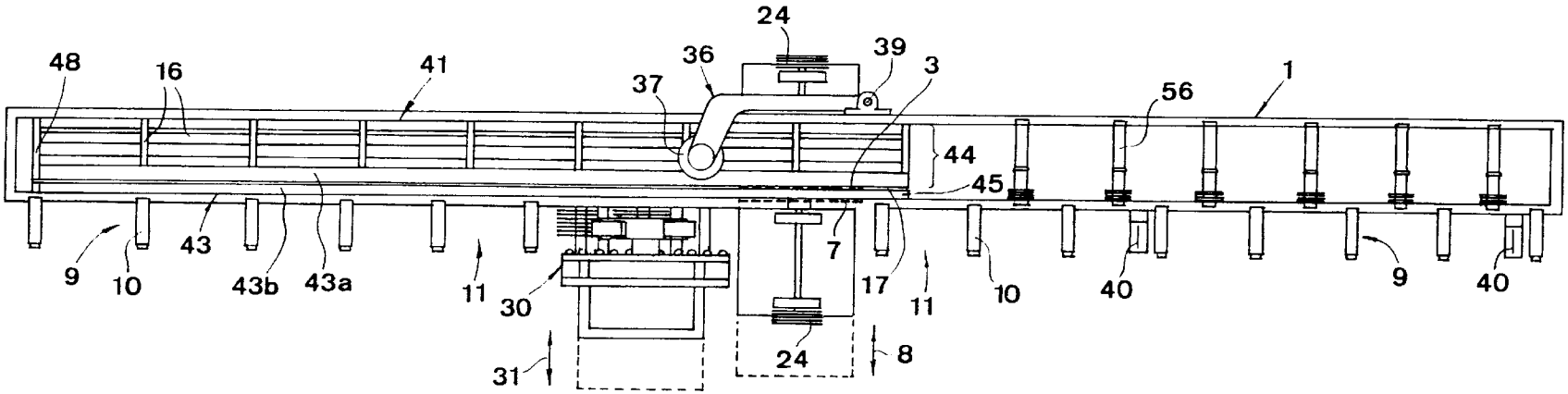
FIG. 11 is a horizontal section of the saw machine similar to FIG. 1, but in a somewhat altered embodiment.
Figure 12:
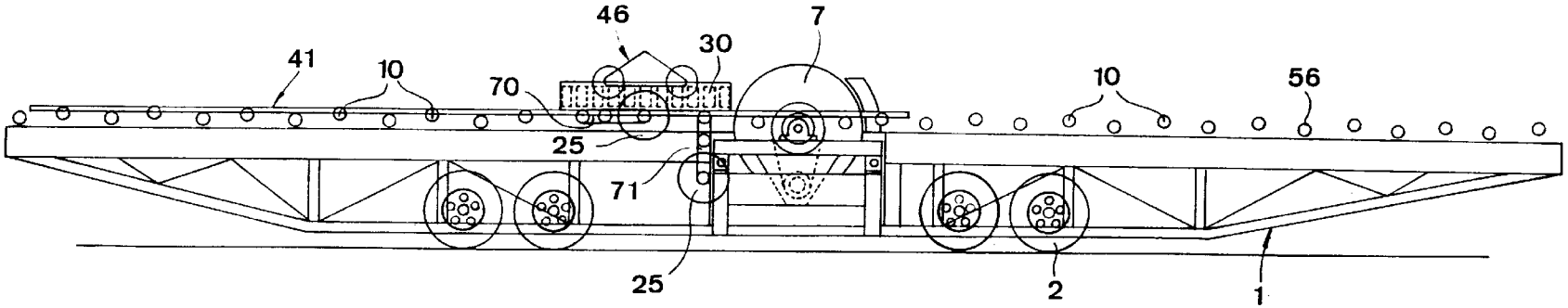
FIG. 12 is a view in side elevation of the machine shown in FIG. 11.

The feed means designated 41 in FIG. 11 is by way of the driving means 42 (FIG. 14) drivable to and fro relative to the support 1, in order to move a timber piece which is to be sawn past sawing means 3 and/or 7. The feed table 41 is equipped with an essentially flat slide face along the cutting plane of sawing means 3. Other driving means are available to urge the timber piece forward by sliding on slide face 43 when the feed table 41 is stationary, lacking driving from the first driving means 42 to be described below.

The feed table 41 comprises two sections 44, 45 as previously, with a slot to allow, entry of sawing means 3 between them. Both these sections 44, 45 have essentially flat slide faces 43*a* and 43*b* respectively, at least in the immediate vicinity of the slot 17.

Section 45 of the feed table 41 is relatively narrow and fitted so as to be movable to and fro in the space between the sawing means 3 and the second sawing means 7. Section 45 has an essentially flat upper slide face 43*b*. The second section 44 of the feed table is wider and, over part of its width, has the flat upper slide face 43*a* in the immediate vicinity of the slot 17.

Slide faces 43*a* and 43*b* and the transport plane formed by the upper periphery of the transporter's 9 rollers 10 are situated on the same level on what in essence is the identical horizontal plane.

The relatively wide section 44 of the feed table 41 has, with the exception of the flat slide face 43*a*, a slotted design incorporating holes formed by longitudinal and latitudinal beams 16 to allow bark, sawdust etc. to pass through the feed table.

As will be described below referring to FIGS. 19 and 20, there is a hold-down means 46 which has been somewhat modified in comparison to the hold-down means 34 in the previously described embodiment.

The side stock 30 (see also FIG. 17) remains largely unchanged, thus serving as a setting instrument in the sawing process as the side stock can be adjusted to the desired position across the direction of the cut. As will be described in more detail in what follows, two supports 70, 71 occur in this instance (FIGS. 11 and 12) for additional sawing means 25.

The two sections 44 and 45 of the feed means 41 can be locked together and unlocked using locking means 47–49. In this embodiment these locking means have the form of a pin 47 and sockets 48, 49 to receive the latter, permanently attached to sections 44, 45 of the feed table at the rear end of the feed table, as indicated at 48 in FIG. 11. By inserting the locking means 47 in the lock sockets 48, 49 in a direction essentially lateral to the path of the feed table 41, an efficient locking of the feed table sections is effected and may be secured by a split pin or similar in a hole in the pin 47. The aforementioned driving means 42 are designed to drive the first section 45 of the feed table without the other section 44 being driven. The narrow section 45 shows a device 51–53 to urge a timber piece past it or the additional sawing means 25 and 7.

Figure 15:
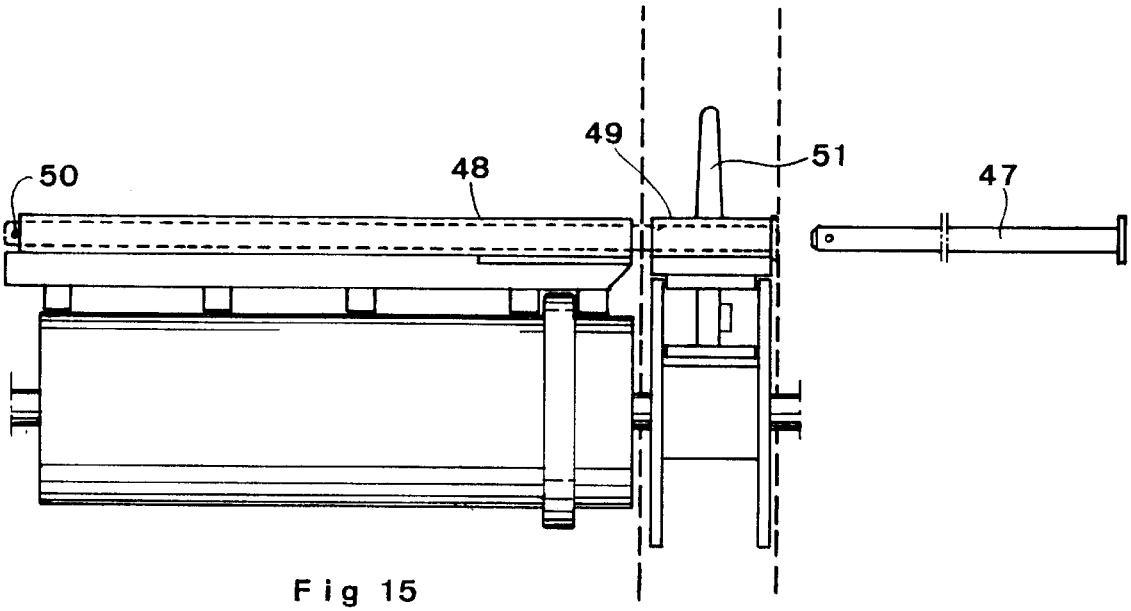
FIG. 15 is a view illustrating the rear end of the feed means and showing the connection between two sections of the feed means.
Figure 16:
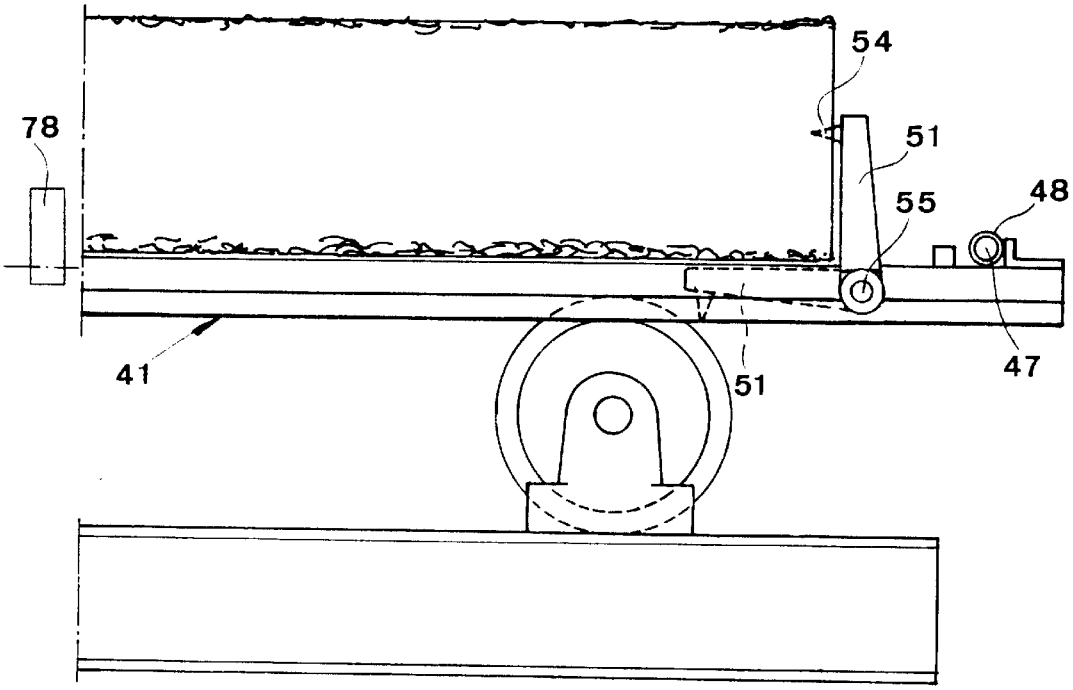
FIG. 16 is an outline view of details shown in FIG. 15 seen from the left and with the addition of a log.

The log holder 51 illustrated in FIGS. 15 and 16 is recommended to be placed at suitable intervals along the feed table section 45, attention being paid to the varying lengths of logs. The holder 51 is designed to act on the rear end of a log by way of a stud 54. It is to be especially recommended that the holder 51 has the form of a folding flap which when in the retracted position does not project higher than the upper flat surface of section 45, but instead is on a level with or somewhat under the latter. In its protracted position, however, the holder 51 is capable of acting efficiently on a log. The holder 51 in the example is rotatably journaled on an axle 55, it would be possible for example to attach a driving means, such as a hydraulic cylinder, to effect movement of the holder 51 between active and passive settings.

FIGS. 15 and 16 also show how the locking means 47, 48, 49 protract above the upper surface of the feed table section 45. Such protraction may however be dispensed with as it may cause disturbances in the feeding of the logs.

Figure 13:
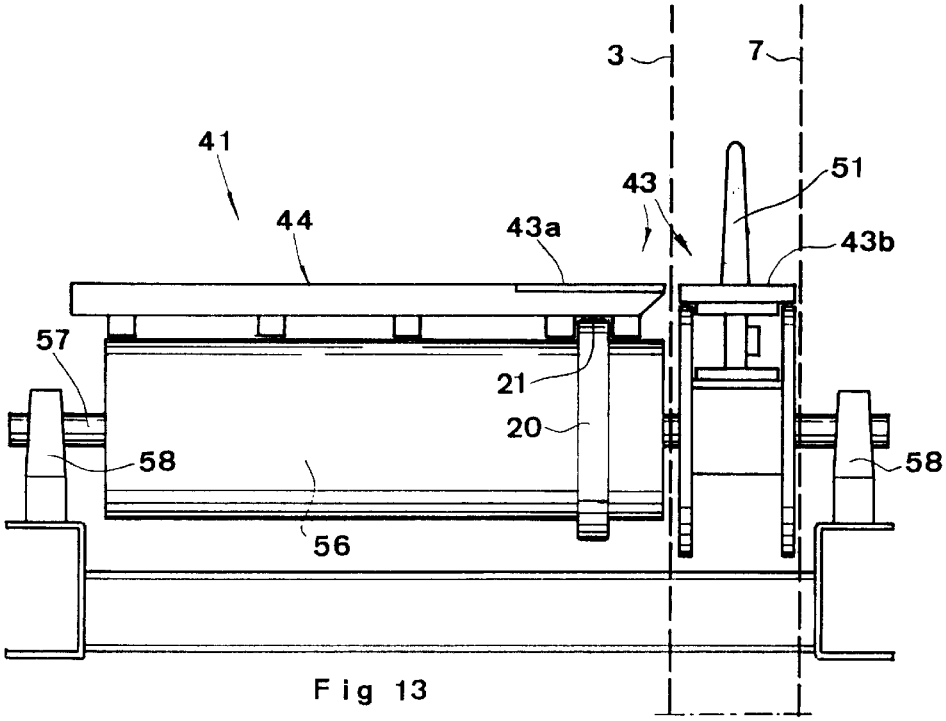
FIG. 13 is a section taken vertically through the machine to show details of the design of the feed means.
Figure 14:
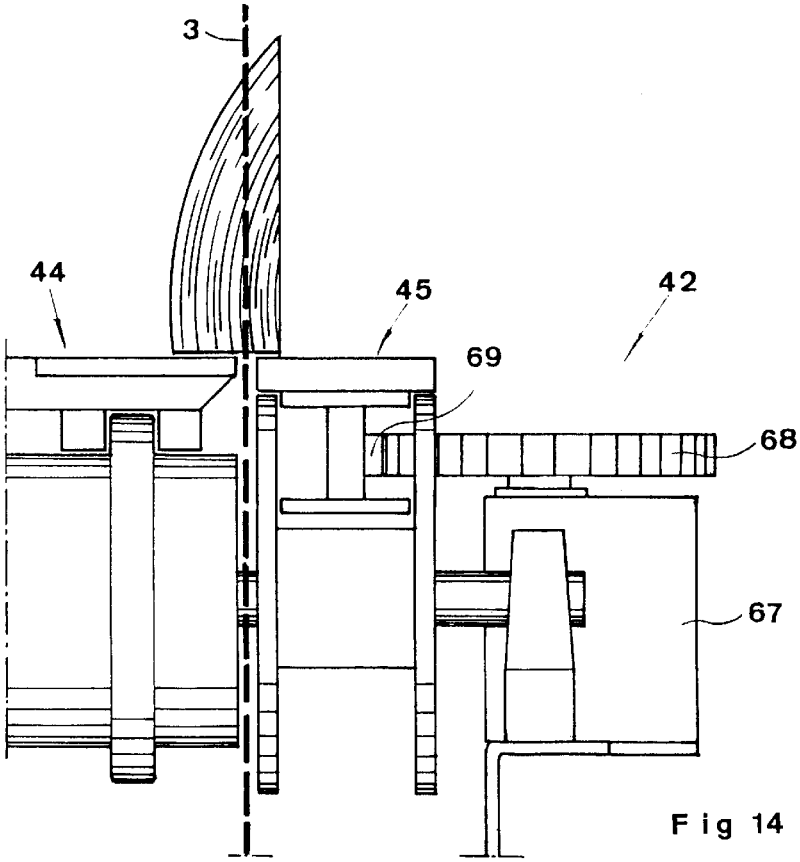
FIG. 14 is yet another detailed view illustrating the feed means together with its drives and bearings

FIGS. 13 and 14 show how feed table section 45 is supported by one of a number of roller elements 56. These together with feed table section 44 show mutually interlocking control means 20, 21 in the form of projections and slots. The roller elements 56 are fixed rotatably on axles 57 supported by bearings 58. The axles 57 also support control means 59 (FIG. 17) which have two end discs 60 and a hub 61, which by way of a bearing 62 are freely rotatably journaled on axle 58. This means that the roller elements 56 and the control means 59 are able to rotate independently of each other. The ends 60 of the control means 59 form the cavities 63 which receive the lower section of the upper feed table section 45. This lower section comprises a flat section 64, the upper side of which forms the flat slide face 43*b*, to the lower surface of which is attached an essentially vertically downward projecting web 65 coordinated with broader flat sections 66 which fit in between the ends 60 of the control means 59.

The control means 42 illustrated in FIG. 14 include a driving motor 67 and a cog wheel 68. When driving, this is connected to an equivalent means 69 fitted along the feed table section 45, more precisely on one side of its web 65. The means 69 constitutes in the example a rack or a chain welded on to the said web.

Figure 17:
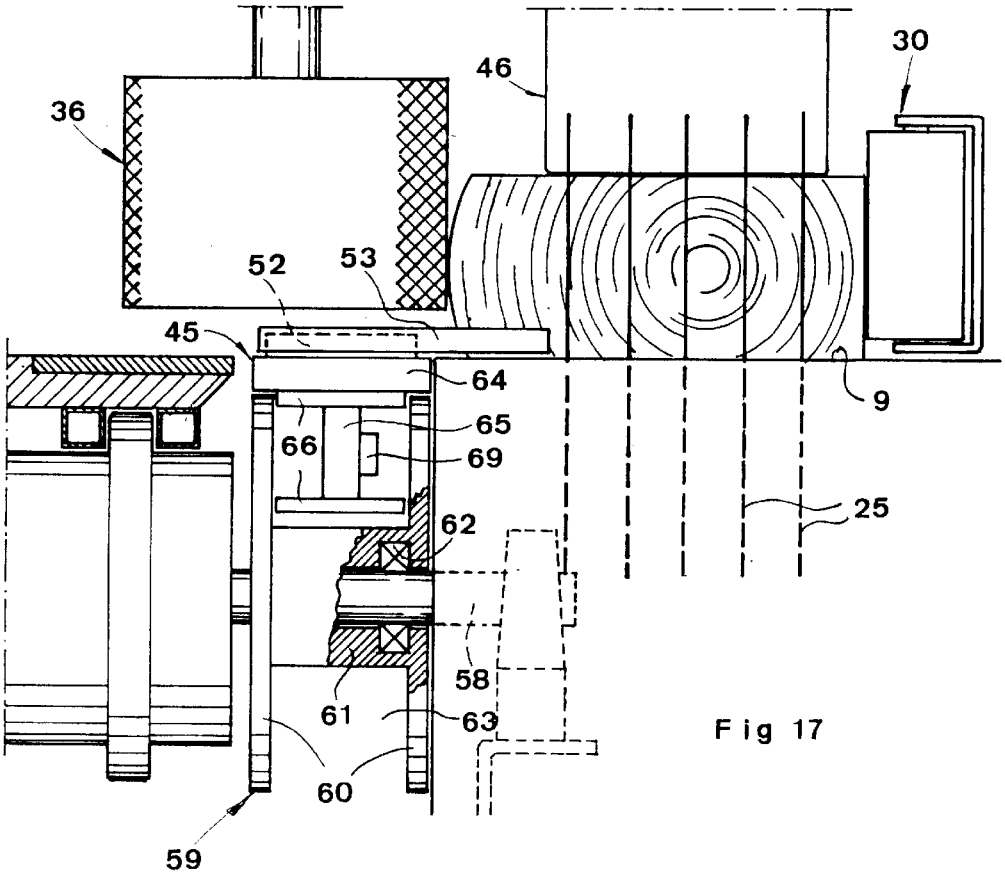
FIG. 17 is a detailed view illustrating the cutting of a timber piece on the transporter.

FIG. 17 shows an outline of the additional sawing means 25 fitted to cut timber pieces being moved along the transporter 9. In the fashion shown in detail in FIGS. 19 and 20, the sawing means are here too fixed manoeuvrably between an active setting, where they are positioned for the cutting of timber pieces on the transporter and an inactive setting, where they are out of the way of timber pieces being moved along the transporter. FIG. 19 shows how the sawing means 25 are divided into two groups comprising at least one sawing means 25 and that these groups of sawing means are fixed on different supports 70 and 71 respectively, fitted so as to bring the sawing means groups 25 into active cutting settings alternately. Given the rotational direction in sawing means 25, they are suited to cutting a timber piece moving to the right in the figure. If, on the other hand, a timber piece moving to the left in the figure is to be cut, the holder 70 is lowered to the position indicated by a dashed line and the other holder 71 is raised so that its sawing means comes into an active settings. This difference in the functions of the sawing means groups is caused by the fact that they are driven rotatably in different directions, as can be seen from the arrows in FIG. 19. It is to be preferred that the sawing means groups 25 assume essentially the same position when in their elevated, active setting, as the position relative to a superior hold-down means then remains constant and thus optimal. This hold-down means 46 shows in the example two contact rollers which can be driven to assist in the forwarding of timber pieces on the transporter 9.

Figure 19:
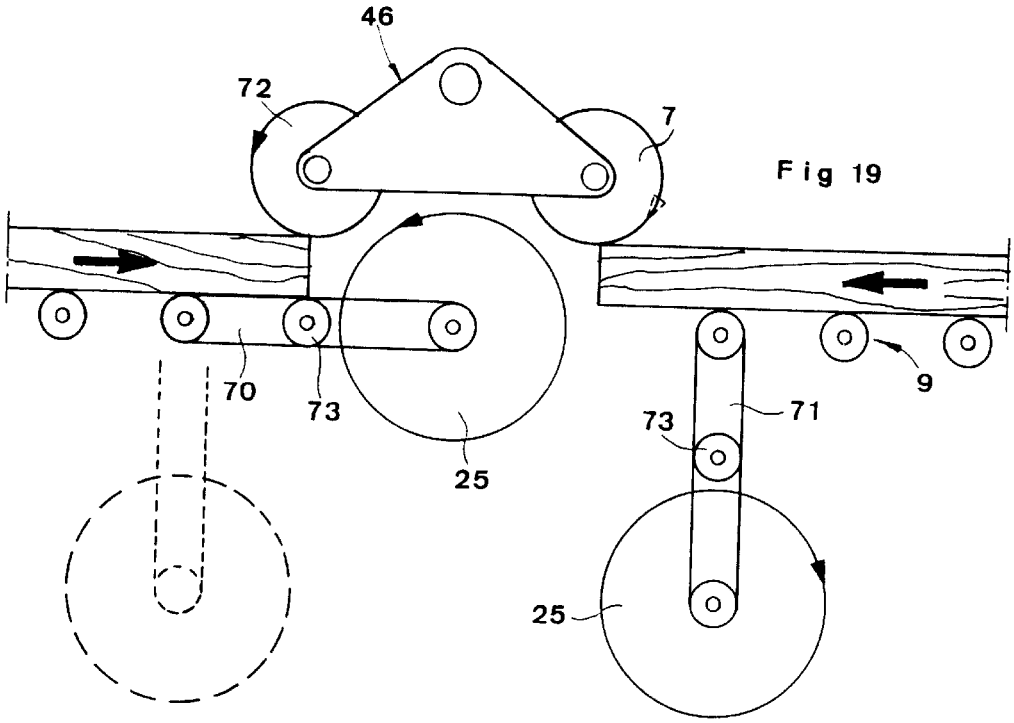
FIG. 19 is an outline view illustrating two means of support for sawing devices fitted to the machine.

As can be seen in FIG. 19, the holders 70, 71 show rollers 73 to support timber pieces. When the holders are in their active setting these rollers 73 are in a setting to actively support timber pieces in order to support the timber pieces in the vicinity of the periphery of the sawing means 25.

Figure 20:
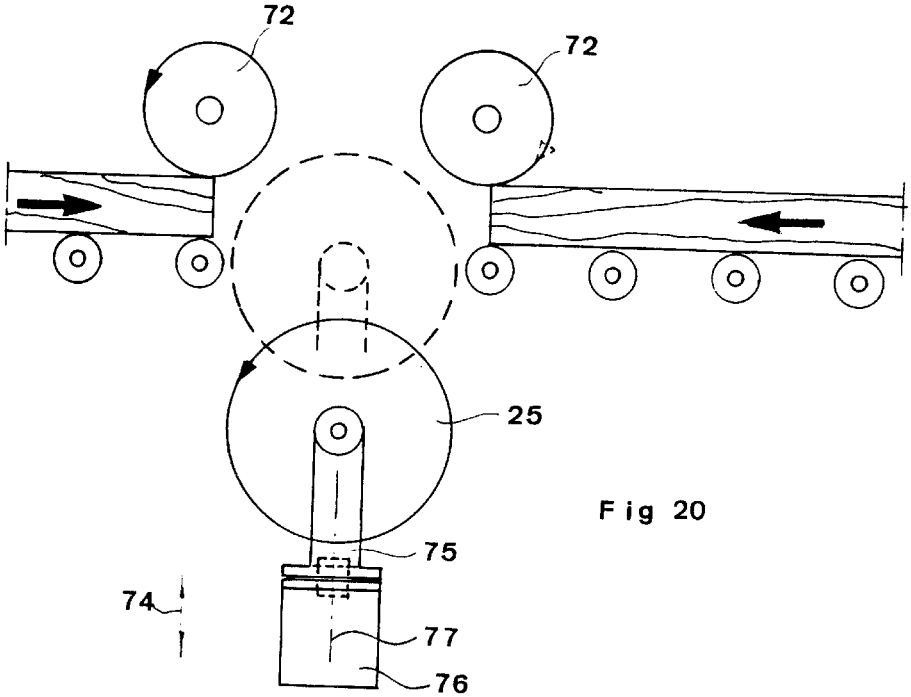
FIG. 20 is an alternative design showing how rotational direction of sawing means can be switched.

In the version in FIG. 20 there is a holder 75 vertically adjustable in the directions shown by the double arrow 74, fitted on a base 76 which can be adjustable rectilinearly and vertically or adjustable rotatably and vertically. The holder 75 itself holds the apropriate number of sawing means 25 and is rotatably adjustable approx 180° between two settings, in which the sawing means 25 are suited through their different directions of rotation to cutting timber pieces arriving in opposite directions on the transporter 9. The said rotation occurs on axle 77.

The embodiments shown in FIGS. 19 and 20 thus enable the timber pieces to be sawn on the transporter 9 during transport in both its directions without any time-consuming readjustments being necessary; only a rapid readjustment of the holders 70, 71 and 75 is necessary.

It should be emphasized that the hold-down means 46 and hold-down means 34 in the earlier embodiment should be adjustable along the transporter 9 and possibly also in its cross direction so that the optimal setting of the hold-down means is always achieved. As the hold-down means is also considered to have a driving function in practice, it is important that the driving effect can be implemented wherever required.

The described embodiment can in principle be used in the same way as the embodiment shown in FIGS. 1–10, i.e. the feed table 41 can be used to move a timber piece or log to and fro past the sawing means 3, 7. This version, however, also includes a refinement which increases capacity, in that in certain sawing operations, as for example ripping slabs, illustrated in FIG. 14, the feed table is set in a stationary position by deactivating its driving means 42. Although the side stock 30 and stop 36 are not shown in FIG. 14 they are intended to be used so that the stop 36 urges the timber piece against the side stock 30. Thanks to the flat slide faces 43*a* and 43*b* on the feed table sections 44, 45 the timber pieces can successively be made to slide along the feed table 41 while one or more driven rollers or similar on the stop 36 provide the necessary driving force. Naturally, additional driving rollers can be fitted if deemed necessary.

When it is necessary to edge blocks of timber essentially in the way illustrated in FIG. 7 in the first embodiment, the locking means 47 can be released so that the feed table sections 44 and 45 can be separated. By activating driving means 42 this means that the narrower section 45 can be made to move to and fro between sawing means 3 and 7, and one or more logs held by log holders 51 can undergo sawing operations. By releasing feed table section 45 from the rest of the feed table, section 45 can be run in its entirety through the cavity between sawing means 3, 7 without touching the sawing means, which of course requires that neither the log holders 51 or other auxiliary components of the section 45 project sideways further than the minimum distance between the sawing means 3, 7.

Yet another advantage of running the narrow feed table section 45 separately to and fro can be seen in FIG. 17. The means 52, 53 are shown as connected with the feed table section 45 and fitted so as to accompany the latter. The means 53 comprises a stop designed to bear against a timber piece located on the transporter 9, in order to assist in moving the timber piece while the latter is undergoing a sawing operation on the transporter 9 using the additional sawing means 25 and/or the second sawing means 7. The stop 53 can, for example, have a slot in its base fitting a projection 52 on the feed table section 45 which fixes elements 52 and 53 in position by way of a split pin or similar. FIG. 17 also shows how a timber piece while being cut is seen as set between the side stop 30 and the stop 36 and in addition the timber piece can be urged onto the transporter 9 using a hold-down means comprising the above component 46 or similar. The design of the feed table section 45, actively driving the timber piece by way of the stop 53 means that expensive feeder roller apparatus can be dispensed with or at least powerfully reduced.

It will of course be realized that in the running situation described in FIG. 17, the sawing means 7 must be drawn away so as not to disturb sawing functions.

Figure 18:
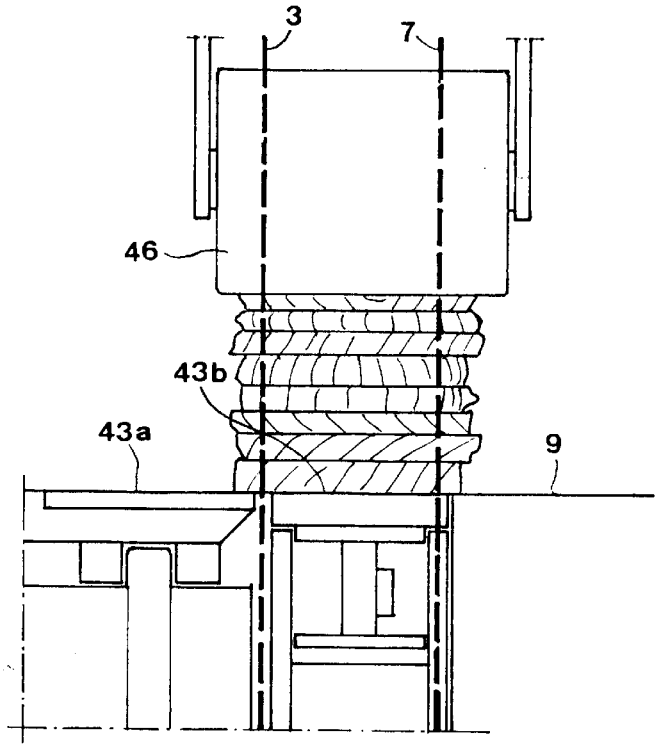
FIG. 18 is a functional view showing the edging of boards.

FIG. 18 shows how a bundle of horizontal boards can be subjected to an edging operation while the boards are being held between a hold-down means 46 and the feed table, more precisely primarily the feed table's section 45. It may be advantageous in this situation too, that only the narrow feed table section 45 is driven while section 44 is allowed to remain stationary.

For efficient functioning it is to be strongly recommended that the slide faces 43*a* and 43*b* as well as the horizontal plane through the transporter 9 forming the upper parts of the rollers 10 are in alignment with each other so that the timber pieces can rest on these various surfaces at the same time in the way shown for example in FIGS. 8 and 18.

The devices described can of course be modified in a number of ways within the framework of the invention concept. For example, it is not necessary that the sawing means 3, 7 and 25 are in the form of circular saw blades; they could for example be band saw units. It should be noted that the number of sawing means designated by the number 7, i.e. laterally adjustable sawing means, is arbitrary. It would also be possible to make the sawing means 3 removable in a downward direction (or possibly upward) to become inactive, in which position the sawing means would not form an obstruction to the forwarding of timber pieces. It can also be noted that the sawing means 3 could be made adjustable across the path of the feed table 4 in order to set this sawing means 3 in a suitable position for sawing. This would, however, require that the feed table were not intended to be used for forwarding a timber piece during this sawing operation, but rather the feed table 4 must be withdrawn so that the sawing means 3 completely vacates the slot 17 in the feed table. It should be understood that the said feed rollers etc. can have either rubber or steel wearing surfaces, as deemed suitable. It may also be pointed out that the sawing apparatus can be fitted with reduction cutters at the infeed end so that these cutters initially remove wood materials that would impair good sawing results. Whenever a hold-down means is mentioned, be it driven or undriven, it should be understood that they of course could be combined with equivalent driven or undriven means or rollers supporting the timber pieces from below. To make sure that a log to be sawn securely interlocks with the log holder 51, it is to be preferred that a stop indicated in FIG. 16 is movably journaled on the support 1 so that it can be manoeuvred between active and inactive settings. In the inactive setting the stop 78 is out of the way of the log. In the active setting, conversely, the stop 78 is so positioned as to come into contact with the front end of the log when the feed table section 45 moves in a forward direction. This will stop the log while the feed table section 45 continues its forward motion and this leads to the rear end of the log being forced into interaction with the holder 51 which has been previously set in the active projecting position. Other modifications are also possible.

I claim:

1. An apparatus for sawing timber, comprising: a stand (1), a first sawing means (3) and feed means (4,41) for supporting timber pieces to be cut and which is movable to and from in relation to said stand so as to forward said timber pieces past said first sawing means; a section (45) of said feed means (4,41) being relatively narrow and being disposed to move to and from in a gap between said first sawing means (3) and at least one second sawing means (7); a transporter (9) for said timber pieces of predetermined width disposed to the side of and along the direction of movement of said feed means (4,41), and said at least one second sawing means (7) being adjustable within at least a part of said predetermined width of said transporter (9); and additional sawing means (25) arranged to cut said timber pieces moving along said transporter (9); and said additional sawing means (25) arranged in an active position when positioned for cutting said timber pieces moving along said transporter (9), and in an inactive position when disposed out of the way of said timber pieces moving along said transport (9); a pressing member (36), and an adjustable side stock (30) for said timber pieces moving in said apparatus, and said adjustable side stock being movable over at least part of said predetermined width of said transporter (9), and said pressing member urging said timber piece against said adjustable side stock; whereby said apparatus enables an operator thereof to saw a timber piece in a variety of different ways.

2. The apparatus of claim 1, further including at least one hold-down means (34,46) to hold down said timber piece against one of said transporter of said feed means or another means supporting a timber piece from below.

3. The apparatus of claim 1, further including hold-down means (34,46) attached to said adjustable side stock so as to accompany its movement.

4. The apparatus of claim 1, wherein an upper surface of the transporter (9) being essentially aligned with an upper surface of the feed means (4,41).

5. The apparatus according to claim 1, wherein said additional sawing means (25) is fitted to at least one vertically movable support (70,71,75).

6. The apparatus according to claim 5, wherein said at least one vertically movable support (75) is rotatably movable approximately 180° between two settings, in which said additional sawing means (25) are, because of their directions of rotation, suited to cutting of said timber pieces arriving in opposite directions on said transporter (9).

7. The apparatus according to claim 5, wherein said additional sawing means (25) are divided into two groups with at least one additional sawing means in each and these additional sawing means groups are arranged on different supports (70,71) to bring the additional sawing means groups into active positions alternately.

8. The apparatus of claim 7, wherein said additional sawing means (25) in said two groups have different directions of rotation.

* * * * *